United States Patent [19]

Wiesbrod

[11] 4,129,804

[45] Dec. 12, 1978

[54] IMAGE DISPLAY DEVICE COMMUTATOR

[75] Inventor: Sherman Wiesbrod, Somerville, N.J.

[73] Assignee: RCA Corporation, New York, N.Y.

[21] Appl. No.: 804,003

[22] Filed: Jun. 6, 1977

[51] Int. Cl.[2] ..... H05B 37/00; H05B 39/00; H05B 41/00

[52] U.S. Cl. ..... 315/169 TV; 315/366

[58] Field of Search ..... 315/169 R, 169 TV, 366

[56] References Cited

U.S. PATENT DOCUMENTS 3,833,833 9/1974 Nelson ..... 315/169 TV

*Primary Examiner*—Alfred E. Smith

*Assistant Examiner*—Robert E. Wise

*Attorney, Agent, or Firm*—E. M. Whitacre; D. S. Cohen; G. E. Haas

[57] ABSTRACT

Electrodes in an image display device are biased by a circuit composed of a first switch means for applying a first potential to one of at least two sets of alternate electrodes. The circuit also includes means for isolating each of the electrodes in a given set from the other electrodes in that set. A second switch means applies a second electrical potential to one electrode in the other set. Alternate embodiments of the present invention relate to multiplexing of the switching circuitry to reduce the number of components.

23 Claims, 7 Drawing Figures

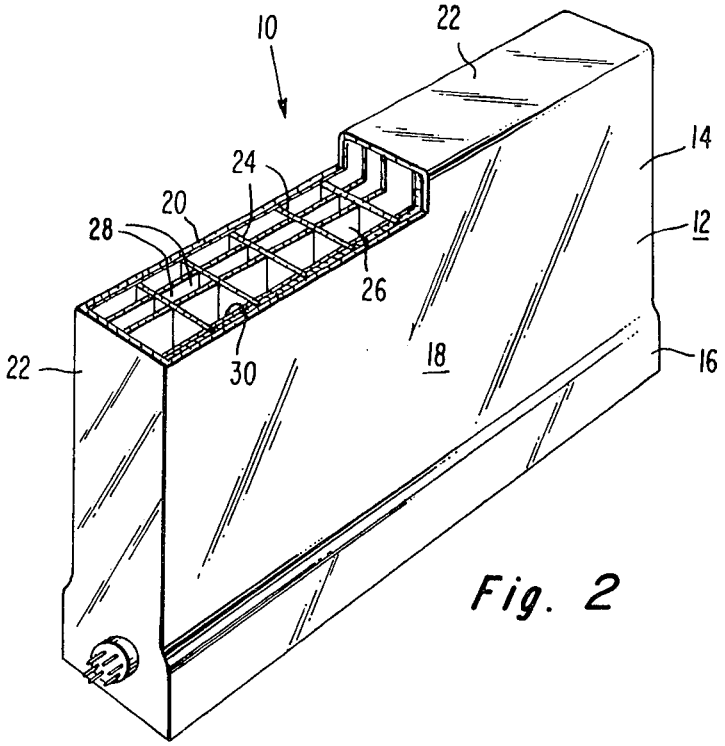
Fig. 2
Fig. 3
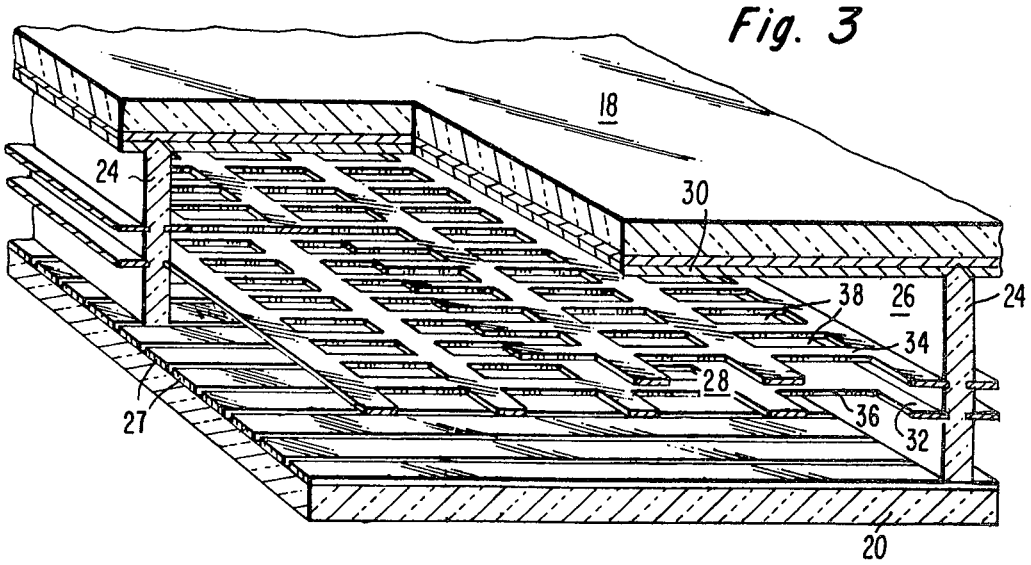

IMAGE DISPLAY DEVICE COMMUTATOR

BACKGROUND OF THE INVENTION

The present invention relates to image display devices and more particularly to commutators for addressing electrodes in such devices.

Many display devices, such as plasma tubes, electron feedback multiplier devices and guided beam devices, display an image by sequentially addressing various electrodes within the device. For example, many of the devices use about 480 electrodes to select the desired horizontal line of the image to be scanned. This selection requires an addressing circuit for switching various electrical potentials to each of the line select electrodes. One such circuit commonly used in the prior art for biasing the electrodes to one of two potentials ($V_1$ or $V_2$) is shown in FIG. 1. The various electrodes 101–104 to be biased are connected to a first voltage $V_1$ via resistors 106. A second or address voltage $V_2$ is connected to the electrodes 101–104 via switches, such as transistors 108. The transistors 108 are controlled by a clock circuit 110.

In the non-addressed state, each of the electrodes 101–104 is maintained at the first voltage level $V_1$ by switching the associated transistor off. Since without current flow there is no voltage drop across the resistor 106, each electrode 101–104 is held at the $V_1$ potential. To address an electrode 101–104, the associated transistor 108 is turned on by clock 110 so as to connect the electrode to the $V_2$ potential. However, in this on state, current flows between the $V_1$ and $V_2$ voltage sources through the associated resistor 106. Since this current flow serves no function in the display device, it adds unnecessary power consumption to the display. In order to reduce the power consumption, the resistors 106 must have a high value. However, in addiition to the unnecessary power consumption of the circuit 100, when an electrode 102 is switched to the address potential $V_2$, the switching transient is coupled to the adjacent electrodes 101 and 103 by the interelectrode capacitance 112 inherent in the physical structure of the device. The RC time constant formed by the interelectrode capacitance 112 and the coupling resistors 106 produces a decay time in the transient electric voltages on the adjacent electrodes, during which period the display device may be inoperative. In order to shorten the time constant, the resistors 106 must be a sufficiently small value, thus creating a tradeoff between the decay time of the transients and the power consumption through resistors 106.

SUMMARY OF THE INVENTION

An image display device commutator for biasing electrodes in the display device comprises two switch means and electrical isolation means. A first switch means alternately applies a first electrical potential to one of at least two sets of alternating electrodes. The second switch means applies a second electrical potential to one electrode in the other set of alternate electrodes. The isolation means electrically isolates each of the electrodes from the other electrodes in its set when one of the potentials is applied but not when the other potential is applied.

BRIEF DESCRIPTION OF THE DRAWINGS

FIG. 2 is a cut-away perspective view of a display device incorporating the present commutator.

FIG. 3 is a cut-away portion of the display device of FIG. 2.

DETAILED DESCRIPTION OF THE PREFERRED EMBODIMENTS

Figure 1:
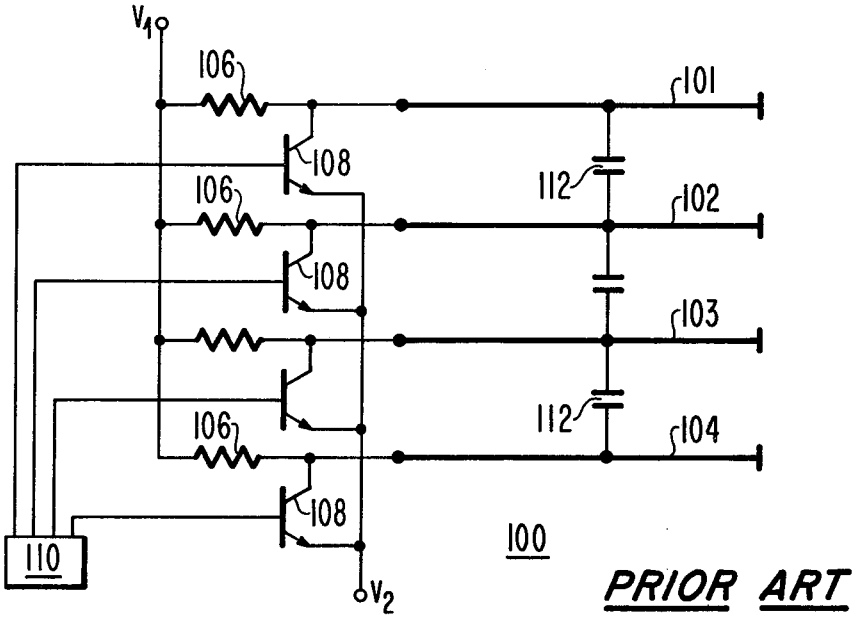
FIG. 1 is a schematic diagram of a prior art commutator.

With reference to FIG. 2, one form of a flat display device with which the present commutator may be used is generally designated 10. The display device 10 comprises an evacuated envelope 12 typically of glass having a display section 14 and an electron gun section 16. The display envelope 12 includes a rectangular front wall 18 and a rectangular back wall 20 in spaced parallel relation to one another connected by side walls 22. A plurality of spaced parallel support walls 24 are secured between the front wall 18 and the back wall 20 and extend from the gun section 16 to the opposite side wall 22. The support walls 24 provide the desired internal support of the device 10 against atmospheric pressure and divide the display device into a plurality of channels 26. Each of the channels 28 contains a plurality of electron beam guides 28. On the inner surface of the front wall 18 is a screen 30 composed of cathodoluminescent phosphors similar to those presently used in cathode ray tubes.

The gun section 16 is an extension of the display section 14 and extends along one set of adjacent ends of the channels 26. The gun section may be of any shape suitable to enclose the particular gun structure contained therein. The electron gun structure contained in the gun section 16 may be of any well known construction suitable for selectively directing beams of electrons along each of the channels 26. For example, the gun structure may comprise a plurality of individual guns mounted at the ends of the channels 26 for directing separate beams of electrons along the channels. Alternatively, the gun structure may include a line cathode extending along the gun section 16 across the ends of the channels 26 and adapted to selectively direct individual beams of electrons along the channels. A gun structure of the line type is described in U.S. Pat. No. 2,858,464 to W. L. Roberts, issued Oct. 28, 1958, entitled "Cathode Ray Tube."

As shown in FIG. 3, the electron beam guides 28 comprise a plurality of stripe electrodes 27 and grid plates 32 and 34. The electrodes 27 extend transversely across the channels 26 on the back wall 20. Between the front wall 18 and rear wall 20 are the first and second grid plates 32 and 34, respectively, which extend transversely across the channels 26 substantially parallel to the back wall 20. Both grid plates 32 and 34 have a plurality of aligned apertures 36 and 38, respectively, extending therethrough aligned with the electrodes 27. A display device of this type is described in U.S. patent application Ser. No. 671,358 entitled "FLAT DISPLAY DEVICE WITH BEAM GUIDE", filed on Mar. 29, 1976 by W. W. Siekanowicz et al., now U.S. Pat. No. 4,088,920, and is incorporated by reference herein.

During the operation of the device, the electrons from the electron gun section 16 travel in each of the beam guides 28 between the first and second grid plates 32 and 34 confined to a beam by proper electrical potentials applied to the electrodes and grid plates. A line of the image to be scanned is selected by negatively biasing one of the electrodes 27. When the beam reaches a point adjacent to the negatively biased electrode 27, it is repelled by the electrode toward the screen, passing through one set of the apertures 36 and 38 in the grid plates 32 and 34.

Figure 4:
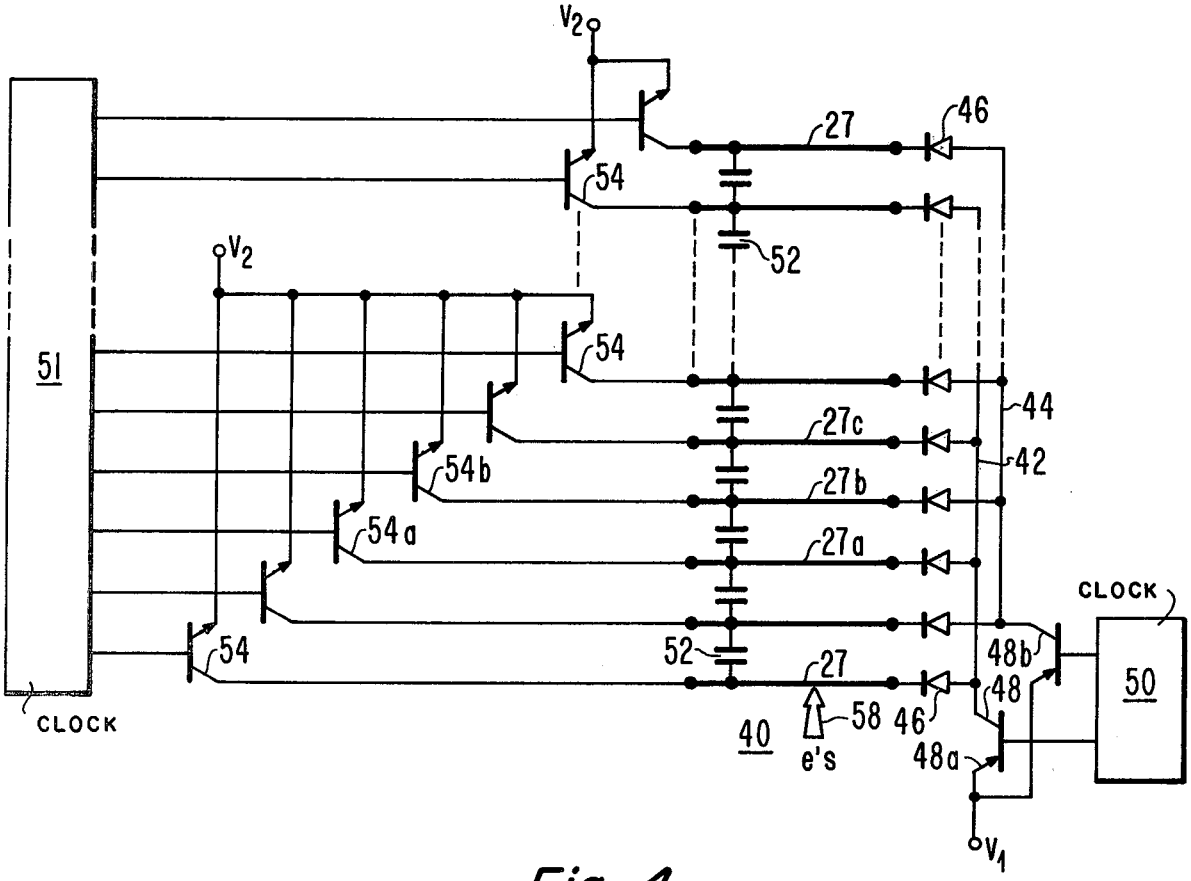
FIG. 4 is a schematic diagram of the present commutator circuit.

As shown in FIG. 4, the biasing of the electrodes 27 for the selection of the display line is accomplished by means of a commutator circuit generally designated as 40. The electrodes 27 are connected in an alternating fashion to one of two primary buses 42 or 44 so as to define two sets of electrodes. A separate diode 46 is connected between each of the electrodes 27 and its corresponding primary bus 42 or 44 with the cathode of the diode 46 connected to the electrode 27. Each of the primary buses 42 and 44 is connected to a positive first potential $V_1$ by a separate first transistor switch 48. The first transistor switches 48 are separately controlled by a first clock circuit 50. Interelectrode capacitance between the electrodes 27 intrinsic in the physical structure of the device 10 is indicated by capacitors 52.

Each of the electrodes 27 is connected to a negative deflection potential $V_2$ by a separate second transistor switch 54. Each of the second transistor switches 54 is controlled by a second clock 51. The first and second clocks 50 and 51 may in fact be a single clock with a number of different timing output lines.

During the operation of the commutator 40, the first transistor switches 48 alternately switch the positive $V_1$ potential to their respective primary buses 42 and 44. The period of the alternate switching of the first transistors 48 is equal to the line time (H) of the display device (e.g., 63.5 microseconds for NTSC television). The charging of the interelectrode capacitance 52 maintains the $V_1$ potential on the electrodes 27 during the "off" time period when they are not connected to the $V_1$ potential. Before the charge on the interlelectrode capacitance can decrease appreciably so that the voltage on the electrode 27 drops below the $V_1$ potential, the corresponding transistor 48 is switched "on" to apply the $V_1$ potential to the formerly "off" electrodes 27. The $V_1$ potential directs and confines the electron beams 58 in guides 28 of the display device. In order to deflect the electron beam 58 toward the screen, the corresponding electrode 27 is biased to the negative deflection potential $V_2$. When a first electrode **27*a* is to be negatively biased to deflect the electron beam, the first transistor 48*a* on the primary bus 42 connected to the first electrode 27*a* is in the "off" portion of its switching cycle. The second transistor 54*a* connected to the first electrode 27*a* is turned on by the second clock 51 so as to connect the electrode 27*a* to the deflection potential $V_2$. The negative $V_2$ potential is blocked from biasing the other electrodes 27 connected to the first primary bus 42 by the diodes 46 which isolate the electrodes 27 from the $V_2$ potential but not the $V_1$ potential. Therefore, the other electrodes 27 which are connected to the first primary bus 42 remain at the $V_1$ potential due to the charge on the intrinsic interelectrode capacitance 52 of the display device. After the image line corresponding to first electrode 27*a* has been displayed, a second electrode 27*b* is to be negatively biased to display another line of the image. During the line blanking time, the first traansistors 48 change state so that the $V_1$ potential is now applied only to the first primary bus 42 and the second electrode 27*b* is connected to the second primary bus 44 which is in its off state. Also, during this blanking time, the second transistor 54*b* connected to the second electrode 27*b* is turned on by the second clock 51 to connect that electrode to the deflection potential $V_2$. The previously "on" second transistor 54*a* is turned off. As described above, the diodes 46 prevent the deflection potential from being applied to the other electrodes 27 connected to the second primary bus 44; therefore, these electrodes remain at the $V_1$ potential. After the second line has been scanned, the transistor switches 48 change states again and the process is repeated for a third electrode 27*c*. The display lines can be scanned in reverse order to the above by clocking the second transistors 54** in the reverse sequence.

The display device commutator 40 in FIG. 4 provides circuitry for applying one of two potentials to the electrodes in a manner so that only one electrode at a time is maintained at the negative deflection potential $V_2$. The primary buses 42 and 44 and the cycling of the first transistor switches 48 prevents the $V_1$ potential from being applied to an electrode 27 which is simultaneously switched to the $V_2$ potential. This eliminates direct current flow between the $V_1$ and $V_2$ sources and the unnecessary power consumption of prior art commutator circuits. In addition, when a given electrode 27 is switched to the deflection potential $V_2$, the adjacent electrodes are directly connected to the $V_1$ potential without using a resistor. Therefore, the present commutator essentially eliminates the RC time constant and the transient voltage decay on adjacent electrodes in the prior art.

Figure 5:
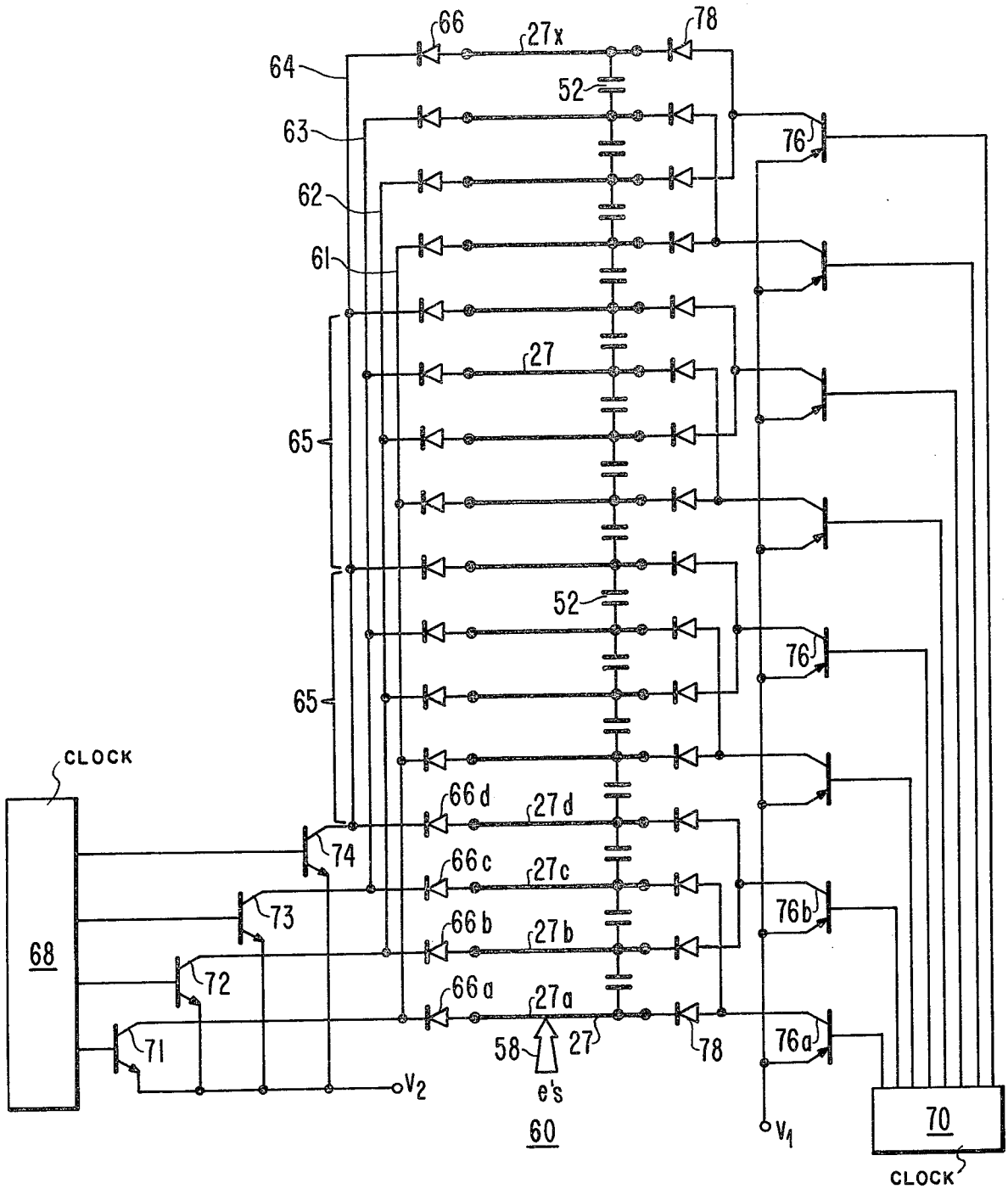
FIG. 5 is an alternate embodiment of the present invention.

With reference to FIG. 5, a second embodiment 60 of the present commutator concept eliminates the use of a separate second transistor connected to each of the electrodes 27. A number of secondary electrical buses 61–64 connect the electrodes 27 to the deflection potential $V_2$. As shown by way of example in FIG. 5, 16 (M) electrodes 27 are connected to one of four (X) secondary electrical buses 61–64 in an alternating manner so that every fourth (Xth) electrode is connected to the same bus. There are four (Y) electrodes 27 connected to each bus 61–64. Each of the electrodes 27 is connected to its respective secondary electrical bus by means of a plurality of first diodes 66 with the anode of each first diode connected to the electrode 27. Variations in the clocking sequence described later may permit the elimination of the first diodes 66 on the first electrodes **27*a–d* nearest the electron source on each bus. A separate bus transistor switch 71–74 connects each of the secondary buses 61–64 respectively to the deflection potential $V_2$. A bus clock 68 sequentially turns on each of the bus transistor switches 71–74. The four electrical buses 61–64 define four (X) groups of alternating electrodes 27. Each group has four (Y) electrodes such that X times Y equals M. The busing of the electrodes 27 also defines (Y) sections 65, each having four adjacent electrodes 27 and each of which is connected to a different secondary bus 61–64**. The number of groups (X) times the number of sections (Y) equals the total number of electrodes (M) (e.g., $4 \times 4 = 16$).

Alternate electrodes 27 in each of the sections 65 are connected in common to one of two section transistor switches 76 which connect the positive $V_1$ potential to the electrodes 27. Each of the section transistor switches 76 is independently controlled by a section clock 70. A plurality of second diodes 78 are connected between separate electrodes 27 and one of the section transistor switches 76 with the cathode of the diode connected to the electrode.

During the operation of the display device 10 when a first electrode 27a is to be biased to the negative deflection potential $V_2$, the section transistors 76 are momentarily turned off. Then the first bus transistor 71 associated with the first secondary bus 61 and the first electrode 27a, is pulsed by the bus clock 68. The pulse momentarily switches the $V_2$ deflection potential to the first secondary bus 61 and biases all of the electrode stripes 27 connected to that bus 61 to the $V_2$ level. After the pulse is applied to the first secondary bus 61, the section transistors 76 are turned on with the exception of the section transistor 76a which is connected to the first and third electrodes 27a and 27c respectively. Therefore, all of the electrodes 27 with the exception of the first and third electrodes 27a and 27c are connected to the electrical potential $V_1$. This includes all of the other electrodes 27 which were connected to the first secondary bus 61 with the exception of the first electrode 27a. The charge on the interelectrode capacitance maintains the first electrode 27a at the $V_2$ potential and the third electrode 27c at the $V_1$ level. As the electron beam 58 travels through the guide it will be deflected at the first electrode which is biased at the deflection potential $V_2$ i.e., electrode 27a.

When the second electrode 27b is to be biased to the $V_2$ deflection potential, the section transistors 76 are turned off. The second bus transistor 72 is pulsed to momentarily apply the $V_2$ potential to the second secondary bus 62 and the second electrode 27b. After the pulse, the section transistor switches 76 are turned on with the exception of the section switch 76b which is connected to the second electrode 27b. Once again, all of the other electrodes 27, with the exception of the second electrode 27b, are maintained at the $V_1$ potential while the second electrode 27b is maintained at the $V_2$ deflection potential. The electron beam 58 will continue to travel through the guide until it is adjacent to the second electrode 27b.

When the third electrode 27c is to be biased to the deflection voltage $V_2$, the third bus transistor 73 is pulsed to connect $V_2$ potential to the third electrode 27c while the section transistors 76 are off. After the pulse, the section transistors 76 are turned on with the exception of the first section transistor switch 76a, which is connected to the first and third electrodes 27a and 27c. Therefore, all of the other electrodes, with the exception of the first and third electrodes 27a and 27c, are directly connected to the $V_1$ potential. Even though the first electrode 27a is not directly connected to the $V_1$ potential, because it was not connected to the third secondary electrical bus 63, the interelectrode capacitance 52 maintains the first electrode 27a at the $V_1$ potential, previously applied to it. However, the potential on the third electrode 27c is maintained by the interelectrode capacitance 52 at the $V_2$ potential. Therefore, the electron beam 58 passing through the guide will be deflected when it is adjacent to the third electrode 27c. In a similar manner, the various transistor switches are clocked during horizontal retrace so as to bias the remaining electrodes 27 to deflect electron beams out of the guide at the various line positions of the display device 10. The second embodiment 60 can scan the display lines in the opposite direction i.e., electrode 27X deflects the beam 58 first and electrode 27a deflects the beam 58 last, by reversing the clocking sequence of the bus and section switches.

The first diodes 66 isolate the electrodes connected to the secondary electrical buses 61–64 from the $V_1$ potential. The two electrodes 27 which are connected to the same section transistor 76, are isolated by the second diode 78 from the deflection potential $V_2$. The first diodes 66a–66d connecting the first four electrodes 27a–27d may be eliminated by proper clocking of the second transistors 76. In this case, when one of the first four electrodes 27a–27d is to deflect the beam, all but the first two section transistors 76a and 76b are clocked off. This prevents the $V_1$ potential from being applied to the first four electrodes 27a–27d via the other electrodes and the secondary buses 61–64.

Figure 6:
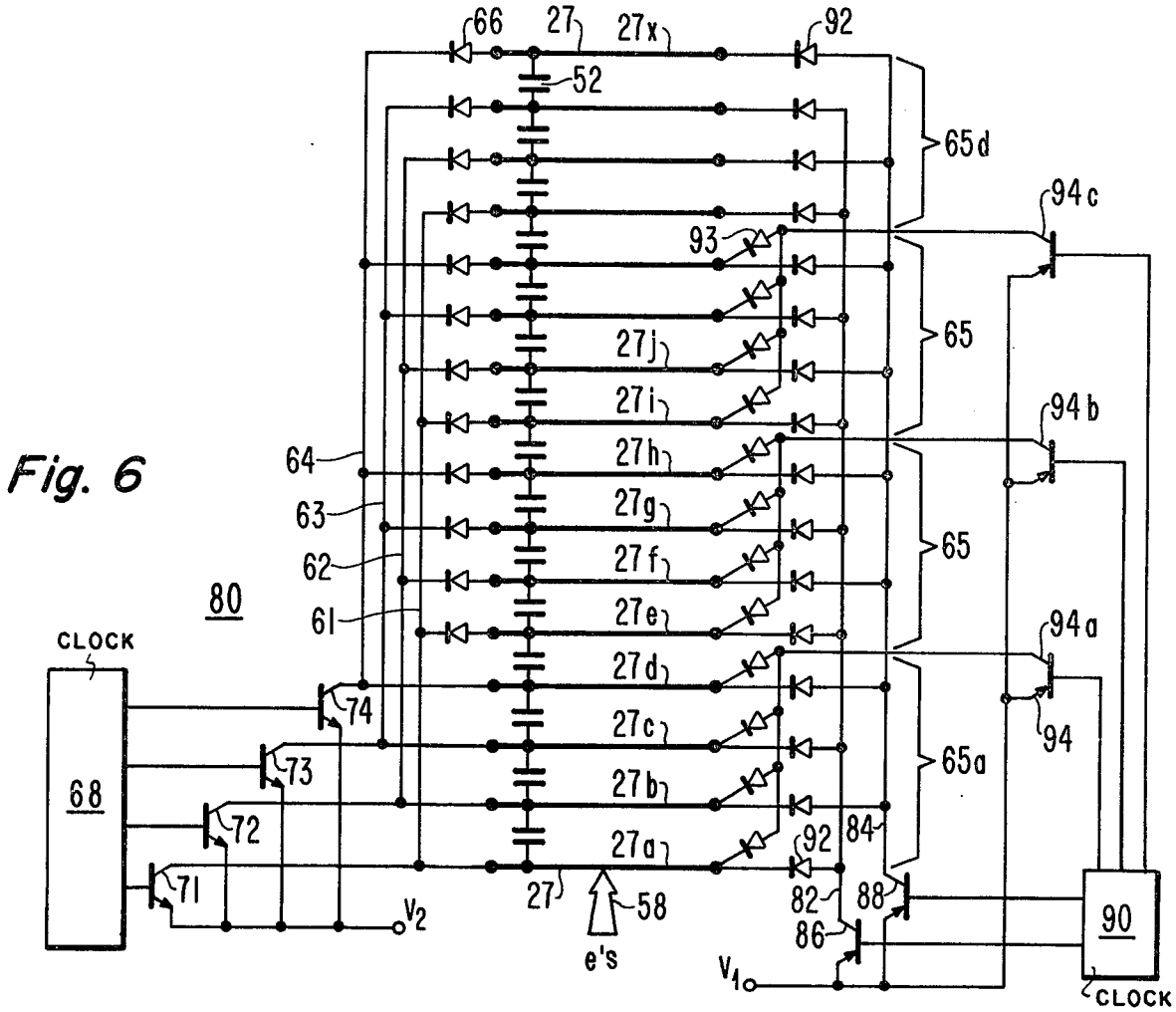
FIG. 6 is yet another embodiment of the present invention.

A third embodiment 80 of the present invention is a hybrid of the first two embodiments 40 and 60. With reference to FIG. 6, the electrodes 27 are connected to one of four (X) secondary electrical buses 61–64 via first diodes 66 as in the second embodiment 40 in FIG. 5. Also, as in the second embodiment, secondary bus transistor switches 71–74 controlled by a first clock 68 apply the negative deflection potential $V_2$ to the secondary buses. The busing defines X groups of Y electrodes connected to the same secondary bus 61–64 and Y sections 65 consisting of adjacent electrodes connected to different secondary buses.

Each of the electrodes 27 is also connected to one of the two primary buses 82 and 84 such that alternate electrodes 27 are connected to the same primary bus. A set of primary bus transistor switches 86 and 88 connect the positive electrical potential $V_1$ to each of the primary buses 82 and 84. A second clock 90 alternately controls the primary transistor switches 86 and 88. A second set of diodes 92 connects each electrode 27 to one of the primary buses 82 or 84 with the cathode of the second diode 92 connected to the electrode. The electrodes 27 in each section of four adjacent electrodes are connected together by a third set of diodes 93 with the cathode of the diodes connected to the electrodes 27 with the exception of the last section 65 which the electron beam 58 encounters. Each section 65 of the interconnected electrodes 27 is connected to the positive potential $V_1$ by a separate section switch 94 which is individually controlled by the second clock 90.

Figure 7:
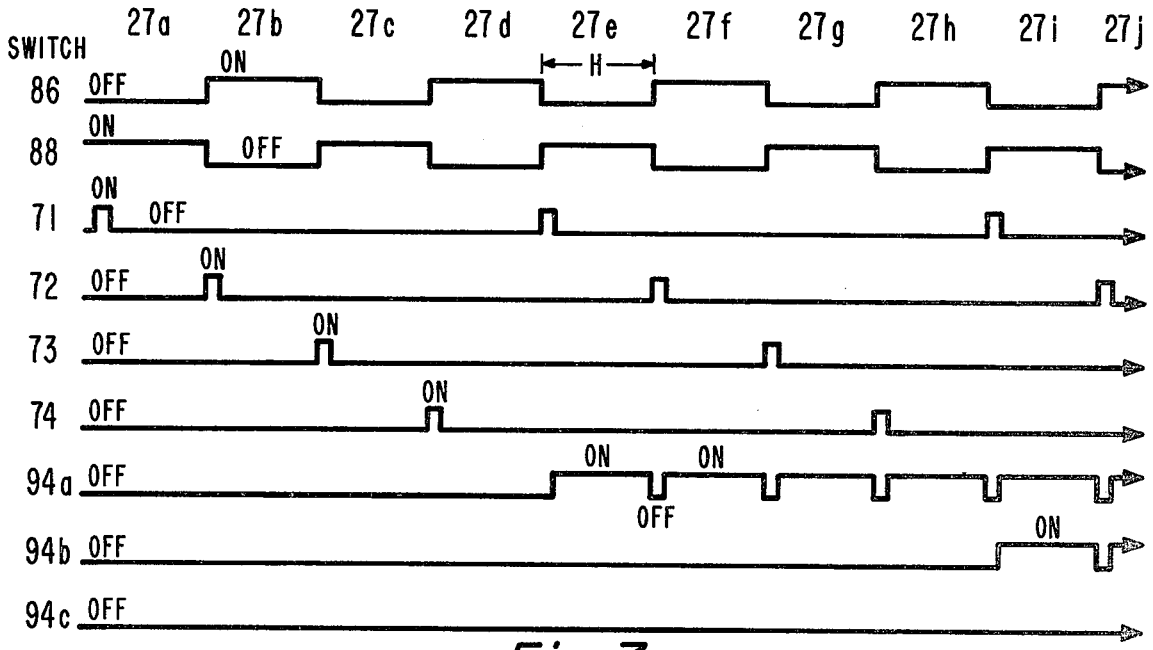
FIG. 7 is a time graph showing the switching sequence of the commutator embodiment of FIG. 6.

During the operation of the commutator 80 in the third embodiment, the clocking of the switches, as shown graphically in FIG. 7, sequentially biases each electrode 27 to the deflection potential $V_2$. The primary transistor switches 86 and 88 are alternately switched on for a period equal to the display line scan time (H). In order to deflect the beam 58 at the first electrode 27a, the first primary transistor 86 is in its low or off state and the second primary transistor 88 is in its high or on state to clamp the second electrode 27b to the $V_1$ level. The first section switch 94a is off. The first bus transistor switch 71 is pulsed briefly to pull the first electrode 27a down to the negative deflection potential $V_2$. After the pulse, the interelectrode capacitance 52 holds the first electrode 27a at the $V_2$ level. The capacitance 52 also keeps the electrodes 27 connected to the first primary bus 82, other than the first electrode 27a, at the $V_1$ level from the previous cycle of the first primary switch 86. The electron beam 58 is deflected by the first electrode 27a. For the deflection at the second electrode 27b, the primary transistors 86 and 88 change states to clamp the first and third electrodes 27a and 27c to the $V_1$ level and disconnect the second electrodes 27b from the $V_1$ source. The first section transistor switch 94*a* remains off and the second bus transistor 72 is pulsed to bias the second electrode 27*b* to the $V_2$ level. The next two electrodes 27*c* and 27*d* are biased in a similar manner.

When the fifth electrode 27*e* is to be negatively biased to deflect the electron beam 58, the first primary switch 86 is off and the second primary switch 88 is on. This clamps the electrodes 27*d* and 27*f* adjacent to the fifth electrode 27*e* to the $V_1$ level. The other electrodes 27 on the first primary bus 82 are also clamped to the positive $V_1$ level. The first bus switch 71 is briefly pulsed to pull down the fifth electrode 27*e* and the other electrodes on the first secondary bus 61 to the negative $V_2$ deflection potential. Then, the first section transistor switch 94*a* is turned on to clamp all the electrodes in the first section 65*a* to the $V_1$ level. Therefore, the first negatively biased electrode that the electron beam 58 encounters is the fifth electrode 27*e*. At the end of the fifth line scan time, the first section switch 94*a* is switched off and the primary switches 86 and 88 change states.

The sixth electrode 27*f* is now going to be biased to the $V_2$ deflection level. The second bus switch 72 is pulsed to pull down the sixth electrode 27*f* to the negative $V_2$ voltage. The section switches 94 are off during the pulsing of the bus switch to prevent current flow directly between the $V_1$ and $V_2$ voltage sources. The first section switch 94*a* is turned on after the pulse on the second secondary bus 62 to clamp the electrodes 27*a*–27*d* in the first section 65*a* to the positive $V_1$ level. The fifth electrode 27*e* is clamped to the $V_1$ potential by the first primary switch 86. The beam 58 will now be deflected at the sixth electrode 27*f*. The remaining electrodes in the display are biased in a similar manner.

The electrodes 27 can be biased to deflect the electron beam 58 in the reverse order to that described above (i.e. deflection occurs first at electrode 27*x* and last at electrode 27*a*). In this deflection pattern, all of the section switches 94 are initially on to clamp the electrodes in their respective sections 65 to the $V_1$ level. The clocking of the bus switches 71–74 is in the reverse sequence to the above. The section switches 94 are then turned off one at a time when one of the electrodes 27 in the corresponding section 65 is used to deflect the electron beam 58.

The first diodes 66 isolate the electrodes 27 connected together by each secondary bus 61–64 from the $V_1$ potential. The clocking and the section switches 94 eliminate the need for first diodes 66 on the first four electrodes 27*a*–27*d*. The second diodes 92 isolate the electrodes 27 connected to the primary buses 82 and 84 from the $V_2$ level. Isolation from the $V_2$ level is also provided by the third diodes 93 for the electrodes interconnected in each section 65. The third embodiment 80 of the present invention represents a trade-off of diodes for transistors over the second embodiment 60 in FIG. 5. Specifically, the third embodiment utilizes fewer transistors and more diodes than the second embodiment.

What is claimed is:

1. An image display device commutator for biasing electrodes in the device comprising:

means for alternately switching a first electrical potential to one of at least two sets of alternate electrodes;

means for switching a second electrical potential to only one electrode in the other set of alternate electrodes; and means for electrically isolating each electrode from the other electrodes in the same set when the second electrical potential is applied but not when the first electrical potential is applied.

2. The commutator as in claim 1 wherein the means for switching the first potential comprises a first means for interconnecting the electrodes in each set; and a plurality of first electrical switches each connected to a separate set of electrodes connected by the first interconnected means.

3. The commutator as in claim 2 wherein the first switches comprise transistors.

4. The commutator as in claim 2 wherein the means for switching the first potential further includes a clock circuit which permits only one of the first switches to be conductive at any given instant.

5. The commutator as in claim 2 wherein the electrical isolation means comprises a plurality of diodes each of which is connected between a separate electrode and the first interconnecting means.

6. A commutator as in claim 2 wherein the means for switching the second potential comprises a separate switch connected to each electrode for connecting that electrode to the second potential.

7. The commutator as in claim 2 wherein the second switch means comprises:

a second means for interconnecting alternate electrodes to one of X groups of Y electrodes so that every Xth electrode is connected to the same group, where X times Y equals the number of electrodes, the second interconnecting means forms Y sections of X adjacent electrodes which are in different groups of electrodes; and a plurality of second electrical switches each connected to a different group of electrodes.

8. The commutator as in claim 7 wherein the means for switching a first electrical potential further comprises a plurality of third electrical switches each connected to the electrodes in a different section.

9. The commutator as in claim 8 wherein the electrical isolation means comprises:

a plurality of first diodes each connected between an electrode and the first interconnecting means;

a plurality of second diodes each diode connected between an electrode and the second interconnecting means; and a plurality of third diodes each connected between an electrode and a third electrical switch.

10. The commutator as in claim 1 wherein the means for switching the first potential comprises a plurality of first switches each connected to two different electrodes spaced one electrode apart.

11. The commutator as in claim 10 wherein the means for switching the second potential comprises:

means for interconnecting alternate electrodes to one of X groups of Y electrodes so that every Xth electrode is connected to the same group where X times Y equals the number of electrodes; and a plurality of second electrical switches each connected to a different group of electrodes.

12. The commutator as in claim 11 wherein the isolation means comprises:

a plurality of first diodes each connected between an electrode and the interconnecting means; and a plurality of second diodes each connected between an electrode and a first electrical switch.

13. In a flat panel image display device having an envelope with a front wall, a rear wall, a cathodoluminescent screen on the front wall, means for generating at least one electron beam, at least one electron beam guide between the front and rear walls, and a plurality of electrodes for deflecting an electron beam out of each guide at various positions along the length of the guide; the improvement including a commutator for biasing the electrodes comprising:

means for alternately switching a first electrical potential to one of at least two sets of alternate electrodes;

means for switching a second electrical potential to only one electrode in the other set of alternate electrodes; and means for electrically isolating each electrode from the other electrodes in the same set when the second electrical potential is applied but not when the first potential is applied.

14. The device as in claim 13 wherein the means for switching the first potential comprises a first means for interconnecting the electrodes in each set; and a plurality of first electrical switches each connected to a separate set of electrodes connected by the first interconnected means.

15. The device as in claim 14 wherein the means for switching the first potential further includes a clock circuit which permits only one of the first switches to be conductive at any given instant.

16. The device as in claim 14 wherein the electrical isolation means comprises a plurality of diodes each of which is connected between a separate electrode and the first interconnecting means.

17. A device as in claim 14 wherein the means for switching the second potential comprises a separate switch connected to each electrode for connecting that electrode to the second potential.

18. The device as in claim 14 wherein the second switch means comprises:

a second means for interconnecting alternate electrodes to one of X groups of Y electrodes so that every Xth electrode is connected to the same group where X times Y equals the number of electrodes, the second interconnecting means forms Y sections of X adjacent electrodes which are connected in different groups of electrodes; and a plurality of second electrical switches each connected to a different group of electrodes.

19. The device as in claim 18 wherein the means for switching a first electrical potential further comprises a plurality of third electrical switches each connected to the electrodes in a different section.

20. The device as in claim 19 wherein the electrical isolation means comprises:

a plurality of first diodes each connected between an electrode and the first interconnecting means;

a plurality of second diodes each diode connected between an electrode and the second interconnecting means; and a plurality of third diodes each connected between an electrode and a third electrical switch.

21. The device as in claim 13 wherein the means for switching the first potential comprises a plurality of first switches each connected to two different electrodes spaced one electrode apart.

22. The device as in claim 21 wherein the means for switching the second potential comprises:

means for interconnecting alternate electrodes to one of X groups of Y electrodes so that every Xth electrode is connected to the same group where X times Y equals the number of electrodes; and a plurality of second electrical switches each connected to a different group of electrodes.

23. The device as in claim 22 wherein the isolation means comprises:

a plurality of first diodes each connected between an electrode and the interconnecting means; and a plurality of second diodes each connected between an electrode and a first electrical switch.

* * * * *